US005979719A

United States Patent [19]

Bayly

[11] Patent Number: 5,979,719

[45] Date of Patent: Nov. 9, 1999

[54] SOFT-BORE MONOBLOCK POURING TUBE

[75] Inventor: George Bayly, Sewickley, Pa.

[73] Assignee: Vesuvius Crucible Company, Wilmington, Del.

[21] Appl. No.: 09/061,923

[22] Filed: Apr. 17, 1998

[51] Int. Cl.[6] ..... B22D 41/08

[52] U.S. Cl. ..... 222/600; 222/606

[58] Field of Search ..... 222/600, 606, 222/590, 603, 607, 591; 164/337, 437, 335

[56] References Cited

U.S. PATENT DOCUMENTS

| | | | |
|---|---|---|---|
| 4,179,046 | 12/1979 | Jeschke | 222/600 |
| 4,248,815 | 2/1981 | Blackburn | 164/438 |
| 4,310,617 | 1/1982 | Bowman | 222/600 |
| 4,434,540 | 3/1984 | Cappelli | 222/606 |
| 5,198,126 | 3/1993 | Lee | 222/600 |
| 5,335,833 | 8/1994 | Rancoule | 222/606 |
| 5,348,202 | 9/1994 | Lee | 222/600 |
| 5,370,370 | 12/1994 | Benson | 222/600 |
| 5,691,061 | 11/1997 | Hanse et al. | 222/600 |
| 5,866,022 | 2/1999 | Hall | 222/600 |

FOREIGN PATENT DOCUMENTS

| | | |
|---|---|---|
| 0198237 | 10/1986 | European Pat. Off. . |
| 2113806 | 8/1983 | United Kingdom . |
| 89/02800 | 4/1989 | WIPO . |

*Primary Examiner*—Scott Kastler
*Attorney, Agent, or Firm*—James R. Williams

[57] ABSTRACT

A refractory pouring-assembly component is disclosed for use in the continuous casting of molten metals, especially steel. The invention is described as reducing thermal shock-induced cracking, including both radial and horizontal cracks. The component comprises a copressed plate and depending pour tube having a bore. The surface of the plate is made from a scratch-resistant refractory material and the pour tube is made from a thermal shock-resistant refractory material. The pour tube extends through and is substantially coplanar with the plate, so that the molten metal sees a joint-free, thermal shock-resistant material throughout the entire length of the bore.

16 Claims, 2 Drawing Sheets

FIG.3
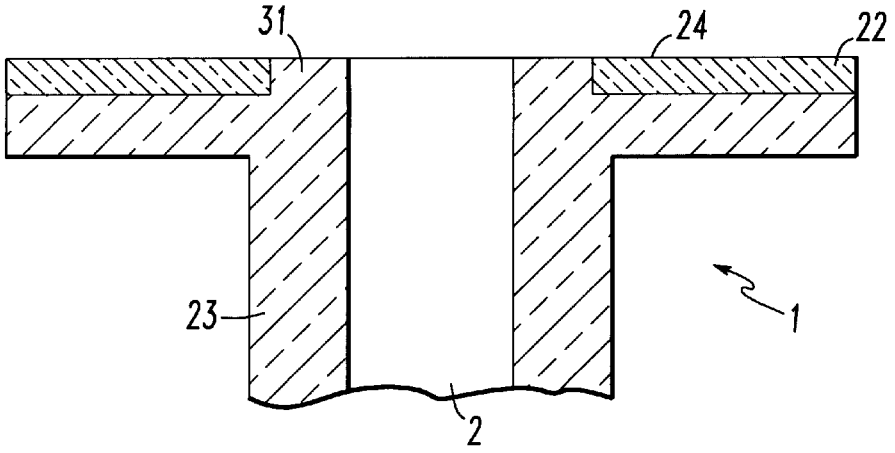
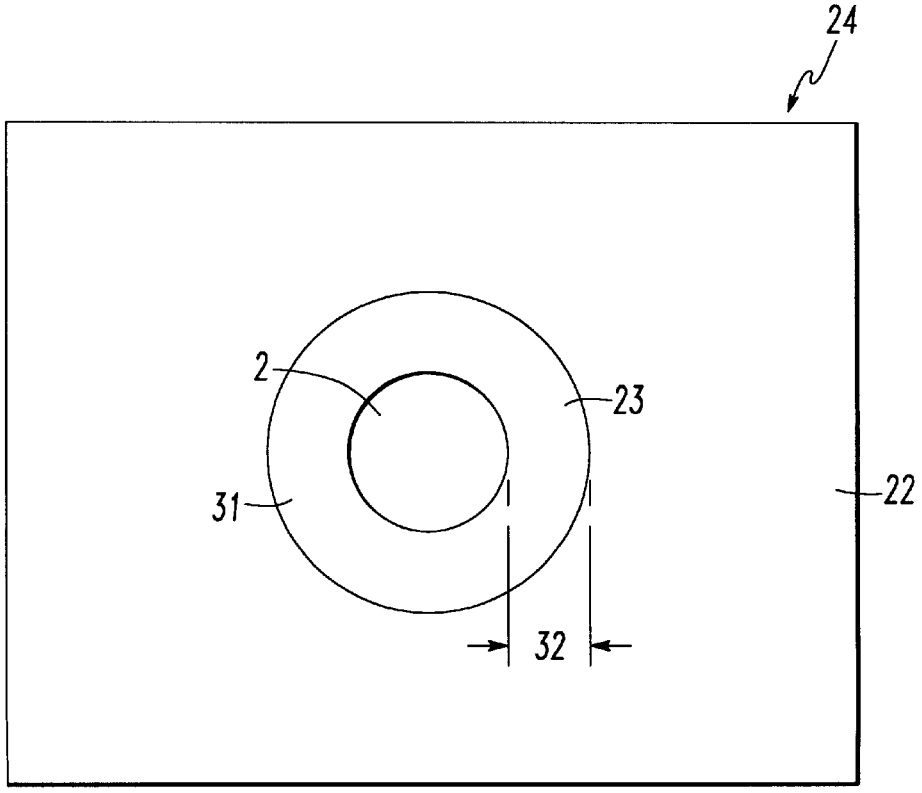
FIG.4

SOFT-BORE MONOBLOCK POURING TUBE

BACKGROUND OF THE INVENTION

1. Field of the Invention

The invention relates to an article comprising a slide gate plate with integral tube. The article is useful in the continuous casting of molten metals and finds particular utility with a tube exchanger mechanism.

2. Description of the Prior Art

In the continuous casting of steel, a stream of molten metal is typically directed from an aperture located at the bottom of a metallurgical vessel through a pour tube and into a second metallurgical vessel or mold. In a first step, the molten steel is directed from a ladle into a tundish through a ladle shroud. In a second step, the molten steel flows from the tundish through a sub-entry nozzle (SEN) or sub-entry shroud (SES) and into a mold. The flow rate of molten steel may be controlled by raising or lowering a stopper rod from a seating position at the aperture. A slide gate valve may also be used to control melt flow.

Pour tubes must be replaced periodically during the casting process. Changing a tube disrupts melt flow and can affect product yield or quality. A tube changer mechanism minimizes this disruption by quickly replacing a spent tube with a new tube. Such mechanisms typically use a hydraulic cylinder to push a spent pour tube out of a casting position and simultaneously drive a new pour tube into the casting position. Product quality is thereby improved because the disruption in the melt flow is reduced.

A tube changer mechanism typically has an upper fixed refractory plate and a lower sliding refractory plate, or tube plate, with an integral pour tube. A top surface of the tube plate compressively engages the lower surface of the upper fixed plate. The combination of the tube plate and pour tube into a single piece is referred to as a monoblock. Frequently, the monoblock is partially metal encased. The upper fixed plate may be connected to a nozzle extending through the aperture of the metallurgical vessel or the nozzle may be integral with the upper fixed plate. In either case, the upper fixed plate has an orifice which aligns with the bore of the nozzle. After exiting the metallurgical vessel and passing through the orifice, the melt stream enters a bore in the monoblock.

Both the upper fixed plate and the tube plate should be hard and scratch-resistant to minimize scoring, which may occur during the tube changing procedure. Scoring creates channels into which molten steel may penetrate. The steel can then solidify inside these channels and cause further damage to the plate surfaces. Scoring may also permit air aspiration into the molten metal. Air, particularly oxygen, has a detrimental effect on the quality of the solidified melt and can also cause clogging of the bore by precipitating oxides from the melt. To facilitate tube changing, a hard surface on the tube plate may be desirable to minimize scoring, break through any solidified steel, or remove precipitates which may have collected inside the bore.

Physical requirements for the pour tube are substantially different from the sliding plate. The pour tube experiences a rapid increase in temperature as molten metal quickly flows into the bore of a newly inserted tube. Thermal shock-resistance, not hardness, is therefore, critical to a pour tube. These conflicting design parameters for the tube plate and pour tube have caused manufacturers to design monoblocks using two or more different ceramic compositions. These two compositions often comprise two or more separate parts, which must then be united.

Various methods are available to join the tube plate and the pour tube. Commonly, a fired pour tube is set in a metal encasement and a fired refractory plate is cemented on top of the tube. This process requires additional manufacturing beyond the single firing step needed for the tube plate or pour tube alone. Additionally, this process creates a joint line between the tube plate and the pour tube. The joint may fail and permit air aspiration into the molten metal stream.

Alternatively, a hard ceramic insert may be cemented into a recess around the bore on the top surface of the tube plate. The body of the piece may thus be formed from a single thermal shock-resistant composition, most typically a carbon-bonded composition such as alumina graphite. The hard, scratch-resistant ceramic around the bore reduces scoring and removes precipitates found within the bore. For example, U.S. Pat. No. 5,335,833 teaches the use of a zirconia insert around the bore. Detrimentally, a joint line is created between the body of the piece and the insert. Such a joint will extend into the bore of the monoblock.

U.S. Pat. No. 5,348,202 succeeds in eliminating the joint in the bore by copressing the hard ceramic with the thermal shock-resistant ceramic. The hard ceramic is distributed on the top surface of the tube plate, most commonly either around the bore or across the entire top surface of the tube plate. This design is susceptible to radial cracking around the bore. It is well known that harder ceramic compositions are more sensitive to thermal shock than softer compositions. Faced with a huge thermal shock from resumption of the melt flow, the hard ceramic around the bore may experience a prodigious amount of radial cracking. Cracking creates avenues for air infiltration into the molten steel and leads to chipping, erosion and solidifying of the steel within the cracks. Geometric variations on this idea, including extending the hard ceramic down the bore, have not eliminated radial cracking. Horizontal cracking may also occur near the junction of the tube plate and the pour tube as the hard ceramic expands with temperature at a greater rate than the shock-resistant ceramic surrounding it.

An alternative solution exists in slide gate plates. UK Pat. Appl. No. 2,113,806A teaches using a softer material around the bore to control radial cracking and a hard material on the plate surface to control scoring. The softer material is present as an insert cemented into a recess of the hard material. Again, a joint remains which permits air aspiration into the molten metal stream.

A need persists for an integral refractory pouring assembly that overcomes the dual requirements of scratch-resistance at the tube plate surface and thermal shock-resistance in the tube and around the bore. Furthermore, the component's design should eliminate joints within the bore, radial cracking around the bore, and horizontal cracking near the tube plate/pour tube junction.

SUMMARY OF THE INVENTION

The present invention relates to a refractory pouring assembly for the continuous casting of molten metals and molten steel in particular. The invention permits molten metal to flow through a bore in the assembly without encountering a joint through which air may be aspirated. The invention also reduces radial and horizontal cracking around and near the bore caused by thermal shock.

In a broad aspect, the assembly comprises a thermal shock-resistant pour tube having a bore copressed with a tube plate having a scratch-resistant surface. The tube plate is described as surrounding and coplanar with one end of the pour tube, and the scratch-resistance material on the surface of the tube plate may be as thin as 1 mm. Typically, the scratch-resistance material will comprise a material commonly used on slide gate plates, such as a high alumina refractory.

One aspect of the invention has the entire top surface of the tube plate surrounding the thermal shock-resistant material so that an annulus of thermal shock-resistant materials is defined around the bore. This geometry may be varied depending on casting conditions. The composition of the pour tube is described as a carbon-bonded material, preferentially an alumina-graphite mix.

In the preferred embodiment of the invention, copressing is accomplished by isostatic pressing. The assembly is suitable for use in a tube exchange mechanism, including, for example, a tube plate with integral pour tube or an upper fixed plate with integral nozzle.

BRIEF DESCRIPTION OF THE DRAWINGS

FIG. 3 is a section through a tube plate with integral pouring tube in accordance with this invention.

FIG. 4 is a top view of a tube plate surface in accordance with this invention.

DESCRIPTION OF THE PREFERRED EMBODIMENT

Figure 1:
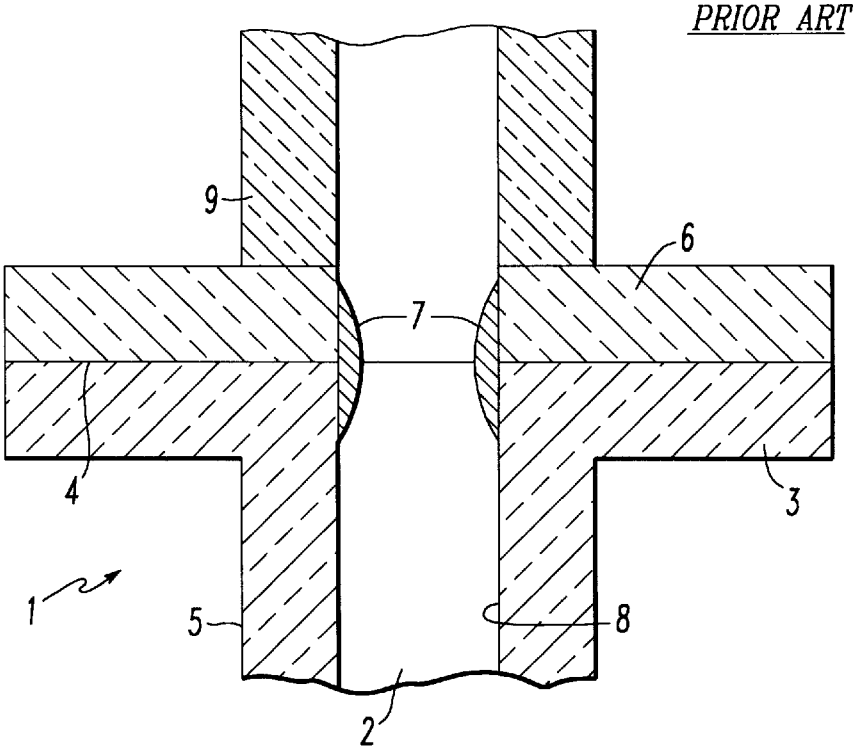
FIG. 1 PRIOR ART
FIG. 1 is a section through a prior art conventional upper slide plate and tube plate with integral pouring tube for use in a tube exchange mechanism.

The continuous casting of metals may utilize a tube changing mechanism in order to boost productivity and minimize scrap. Such mechanisms require refractory components, such as an upper nozzle, an upper fixed plate, a tube plate and a pour tube. Commonly the tube plate and pour tube are joined to form a monoblock, and the top surface of the monoblock is then compressively engaged against the lower surface of the upper plate. The upper nozzle and the upper, fixed plate may also be joined to form a monoblock. FIG. 1 shows a monoblock 1, an upper fixed plate 6 and a nozzle 9 according to the prior art. The monoblock 1 comprises a tube plate 3 and pour tube 5. The monoblock 1 is held in compressive relationship with the upper fixed plate 6 so that a flat, sliding interface 4 is maintained. The interface 4 should be air-tight and resistant to scoring or scratching caused during the tube exchange procedure.

Both the upper fixed plate 6 and the monoblock 1 define a bore 2 through which molten steel may flow. During casting, deposits 7 may form along the inner wall of the bore 8 and may extend across the sliding interface 4. Deposits 7 impede movement of the tube plate 3 relative to the upper fixed plate 6. The deposits 7 may be, for example, oxide precipitates or partially solidified metal.

Figure 2:
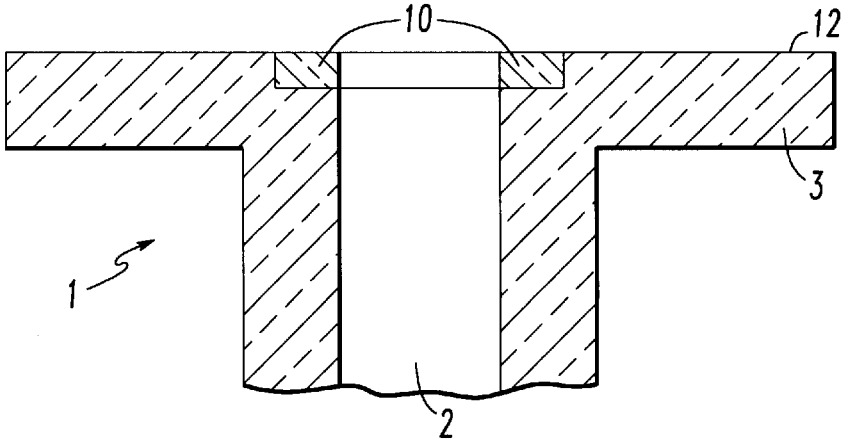
FIG. 2 PRIOR ART
FIG. 2 is a section through a prior art tube plate with integral pouring tube, in which the lower slide plate contains an insert.

Another prior art monoblock design is depicted in FIG. 2. An insert 10 of a hard refractory material surrounds the bore 2 on the top surface 12 of the tube plate 3. The hard insert 10 is described as necessary to cut through deposits within the bore 2 and to prevent fracture of the monoblock 1 itself.

The present invention, as shown in FIG. 3, is a monoblock 1 comprising a copressed plate portion 22 and body portion 23. The plate portion 22 is comprised of a scratch-resistant material, at least on its top surface 24. The body portion 23 has a bore 2 which is completely circumscribed by one or more thermal shock-resistant materials comprising the body portion 23. FIG.4 shows the top surface 24 of a variation on the current invention, wherein, the body portion 23 creates an annulus 31 around the bore 2. The annulus is surrounded by the plate portion 22, and has a width 32.

In the preferred embodiment the assembly is isostatically pressed from powder refractory mixes by methods well-known to those skilled in the art. It is contemplated that the invention subsumes many geometric and compositional variations. Geometric variations include, but are not limited to, length, diameter, flare of the tube, wall thickness, plate thickness, number of ports, or existence of a slag line sleeve, or air/argon injection ports. All are well-known in the art. This invention also permits several new geometric variations including, but not limited to, thickness of the scratch-resistant plate, shape of the thermal shock-resistant material on the top surface and width of the thermal shock-resistant material around the bore on the top surface. It will be understood that several refractory mixes may be used in manufacturing the article of the present invention provided the article has a scratch-resistant plate and a thermal shock-resistant material circumscribing the bore throughout the length of the article.

The scratch-resistant plate will commonly be about 10 mm to 40 mm thick. This range represents a convenient thickness amenable to the manufacturing process. Of course, a thinner plate may be used and it is contemplated that a thickness as low as 1 mm would provide the required scratch-resistance to the monoblock. Plates thicker than 40 mm may also be used. Normally, the plate thickness will be around 25 mm.

The invention requires that a thermal shock-resistant material completely circumscribe the bore. Commonly, the material will be uniformly distributed about the bore so that the material will define an annulus, as shown in FIG. 4. The annulus 31 will typically have a width 32 between about 10 and about 25 mm. A convenient width is about 15 mm; although, the width may range from about 1 mm to about 75 mm. The shock-resistant material, need not be distributed as an annulus or even symmetrically around the bore. Any shape may be used, including an oval, ellipse, square, or any regular or irregular projection. For convenience, any shape circumscribing the bore will be referred to as an annulus. Irregular shapes may be preferred when deposits accumulate between the plates or within the bore. In these situations, the width of thermal shock-resistant material around the bore may be reduced to permit more of the harder, scratch-resistant material. Asymmetry may be favored because a tube changer pushes a monoblock only in a single direction. Consequently, a leading edge in front of the bore may experience little resistance to movement while a trailing edge, which must overcome deposits within the bore and solidified metal between the plates, may experience significant resistance. A lesser width of thermal shock-resistant material may, therefore, be preferred along the trailing edge in favor of harder, scratch-resistant material.

As previously stated, the width of shock-resistant material around the bore is conveniently about 15 mm. The actual width depends upon many factors, such as casting conditions, refractory composition, the type of steel being cast, and the kind and amount of deposits. For example, air aspiration through joints, cracks, and even through the refractory itself tends to create deposits. To overcome this problem, refractory liners are often applied to the inner surface of the body, which defines the bore. Liners may impede air infiltration and may also possess certain anti-stick properties so that the accumulation of deposits is diminished. In situations, where deposits are more likely to form or radial cracking is less likely to occur, thinner sections of shock-resistant material will be favored. Alternatively, when deposits are less likely to form or radial cracking is problematic, thicker sections of shock-resistant material will be preferred.

In addition to geometric variations, the compositions of the scratch-resistant and thermal shock-resistant materials may vary. The scratch-resistant material will be a refractory composition typically used for slide gate plates. An example of such materials is high alumina compositions, which typically contain at least 75 weight percent alumina with the balance comprising silica, graphite or zirconia. Alternative scratch-resistant compositions include alumina-zirconia, zirconia, and magnesia compositions. Alumina-zirconia compositions comprise about 20–60 weight percent alumina and about 10–50 weight percent zirconia with a balance of less than about 40 weight percent other compounds such as, for example, silica, graphite and calcia. Zirconia compositions will commonly comprise over about 60 weight percent zirconia, and magnesia compositions will comprise over about 60 weight percent magnesia.

In addition to the above named compositions, suitable scratch-resistant compositions may be identified by their physical properties. Suitable compositions will have a room temperature modulus of rupture (MOR) of at least about 1500 psi, and preferably above about 2500 psi.

A thermal shock-resistant composition is most typically an alumina-graphite. Compositions may range from about 45 to about 80 weight percent alumina with the balance comprising graphite. Preferably, the composition comprises about 62–67 weight percent alumina, about 20–25 graphite, with the balance comprising silica, zirconia, silicon, and other oxides. Key to the selection of the thermal shock-resistant material is its thermal expansion. A suitable refractory for the body portion will have a coefficient of thermal expansion below about $6\times10^{-6}/°$ C., and preferably about $4\times10^{-6}/$ C.

The pouring assembly of the present invention may be used as either (a) an upper fixed plate and nozzle or (b) a lower sliding plate and pouring tube. In either embodiment, the assembly finds important utility as a refractory in a tube changer mechanism or in a slide plate valve. A tube changer for a tundish has an upper fixed plate with a nozzle extending into a metallurgical vessel and a lower sliding plate, or tube plate, with a pour tube extending into a casting mold. Most commonly, the assembly will be used as the tube plate/pour tube combination. For improved ruggedness, this combination is most often metal encased beginning at the perimeter of the tube plate and proceeding partway down the pour tube. The actual amount of the pour tube encased may vary. The assembly may alternatively be used as the upper fixed plate and nozzle. In this embodiment, the assembly is not typically metal encased.

In either embodiment, it will be appreciated that several ceramic compositions may be used in the manufacture of a single article. For example, the body portion of a monoblock may consist of one or more thermal shock-resistant materials surrounding the bore, an erosion resistant refractory on the exterior of the body portion at the slag line, and a porous ceramic for gas injection encapsulated within the thermal shock-resistant materials. The thermal shock-resistant materials may range from a harder material at the top surface of the monoblock to a softer material downstream from the tube plate.

The following example shows how the invention may be practiced but should not be construed as limiting the invention. obviously, numerous modifications and variations of the present invention are possible in light of the above teachings. It is therefore to be understood that within the scope of the appended claims, the invention may be practiced otherwise than as specifically described herein.

EXAMPLE

A monoblock was made using a flexible mold having a top end, a bottom end and a central axis between the two ends. The bottom end of the mold described a tube plate, and a tubular portion extended from the bottom end to the top end. The bottom end of the mold defined the top surface of the tube plate. A steel mandrel was placed along the axis. A first mix was placed at the bottom end to a depth of 15 mm, except for a 15 mm wide annulus around the mandrel. The first mix had a refractory portion comprising about 85 weight percent alumina and about 10 weight percent graphite. A second mix was added to completely fill the mold, including the 15 mm wide annulus around the mandrel. The second mix had a refractory portion comprising about 65 weight percent alumina, about 23 weight percent graphite, about 5 weight percent zirconia, and about 4 weight percent silica. The filled mold was isostatically pressed below about 20,000 psi to form a pressed piece. The piece was removed from the mold, and the mandrel was extracted to define a bore. The piece was then fired below 1100° C. in a reducing atmosphere to form a monoblock. After firing, the first mix produced a scratch-resistant refractory, and the second mix created a thermal shock-resistant refractory.

The monoblock was encased in metal except for the bottom end of the plate and the top surface of the tube plate. The piece was then preheated and placed into a waiting position in a tube changer mechanism. The tube changer was already attached to a tundish containing molten steel. A stopper rod halted the flow of molten steel. The monoblock was pushed into an operating position by a hydraulic cylinder. In the process, the monoblock displaced a second monoblock which had been in the operating position. The stopper rod was lifted to restart the flow of molten steel. Molten steel flowed from the tundish, through the bore of the monoblock, and into a casting mold. The piece was removed from operation after 6 hours.

Visual inspection of the used piece revealed no radial cracking around the bore. The piece was sectioned to inspect for horizontal cracks, but none were evident. Additionally, the piece effectively severed any deposits, which may have formed during operation.

I claim:

1. A refractory pouring assembly for the continuous casting of molten metals comprising:

(a) an elongated body having an inner surface defining a bore, the body comprising a thermal shock-resistant refractory material, the body having a first end and a second end; and (b) a plate having a smooth, flat surface surrounding the first end of the body, the surface substantially coplanar with the first end of the body, the surface comprised of a scratch-resistant refractory material, and the plate having been copressed with the body.

2. The assembly of claim 1 wherein the body and the plate comprise a joint-free, one-piece composite member.

3. The assembly of claim 1 wherein the assembly is isostatically pressed.

4. The assembly of claim 1 wherein the scratch-resistant refractory material is at least 10 mm thick.

5. The assembly of claim 1 wherein the surface of the plate defines an annulus around the bore of the body and the annulus has a width of at least 10 mm.

6. The assembly of claim 1 wherein the thermal shock-resistant material has a thermal expansion coefficient below about $6\times10^{-6}/°$ C.

7. The assembly of claim 1 wherein the thermal shock-resistant material is alumina graphite comprising between about 50 to about 80 weight percent alumina and between about 20 to 50 weight percent graphite.

8. The assembly of claim 1 wherein the scratch-resistant refractory material has a room temperature modulus of rupture above about 2500 $MN/m^2$.

9. The assembly of claim 1 wherein the scratch-resistant refractory material comprises at least about 50 weight percent alumina.

10. A refractory pouring assembly for the continuous casting of molten metals wherein the assembly is part of a tube exchange mechanism having a tube plate and an upper fixed plate, the assembly comprising:

(a) an elongated body having an inner surface defining a bore, the body comprising a thermal shock-resistant refractory material, the body having a first end and a second end; and (b) a plate having a smooth, flat surface surrounding the first end of the body, the surface substantially coplanar with the first end of the body, the surface comprised of a scratch-resistant refractory material, and the plate having been copressed with the body.

11. The assembly of claim 10 wherein the plate comprises the tube plate and the second end of the body extends into a casting mold.

12. The assembly of claim 10 wherein the plate comprises the upper fixed plate and the second end of the body extends into a metallurgical vessel.

13. A refractory assembly for use in the continuous casting of molten metals, the assembly comprising:

(a) an elongated body having an inner surface defining a first bore, the body having a top end and a bottom end;

(b) an annulus defining a second bore, the annulus fixedly attached to the top end of the body so that the first bore and the second bore are aligned, the annulus comprising a thermal shock-resistant refractory material; and (c) a plate having a smooth, flat surface surrounding and coplanar with the annulus, the surface comprising a scratch-resistant refractory material, and the plate surface having been copressed with the body and the annulus.

14. The assembly of claim 13, wherein the assembly is used in a tube exchange mechanism having a tube plate and an upper fixed plate.

15. The assembly of claim 14, wherein the plate comprises the tube plate and the bottom end of the body extends into a casting mold.

16. The assembly of claim 14, wherein the plate comprises the upper fixed plate and the bottom end of the body extends into a metallurgical vessel.

* * * * *